US010240353B2

(12) United States Patent
Procton et al.

(10) Patent No.: US 10,240,353 B2
(45) Date of Patent: Mar. 26, 2019

(54) SHIPPING SYSTEM WITH PRE-HUNG DOOR

(71) Applicant: Endura Products, Inc., Colfax, NC (US)

(72) Inventors: Bruce E. Procton, Greensboro, NC (US); Tomasz Jaskiewicz, Oak Ridge, NC (US); Michael K. Mitchell, Winston-Salem, NC (US)

(73) Assignee: Endura Products, Inc., Colfax, NC (US)

( * ) Notice: Subject to any disclaimer, the term of this patent is extended or adjusted under 35 U.S.C. 154(b) by 148 days.

(21) Appl. No.: 15/392,587

(22) Filed: Dec. 28, 2016

(65) Prior Publication Data

US 2017/0204621 A1 Jul. 20, 2017

Related U.S. Application Data

(60) Provisional application No. 62/279,025, filed on Jan. 15, 2016.

(51) Int. Cl.

| | |
|---|---|
| ***E06B 1/00*** | (2006.01) |
| ***E04F 21/00*** | (2006.01) |
| ***E06B 7/28*** | (2006.01) |
| ***E06B 1/52*** | (2006.01) |
| ***E06B 3/70*** | (2006.01) |

(52) U.S. Cl.

CPC ..... *E04F 21/0023* (2013.01); *E06B 1/52* (2013.01); *E06B 3/70* (2013.01); *E06B 7/28* (2013.01)

(58) Field of Classification Search

CPC ..... E06B 3/70; E06B 1/52; E06B 7/28; E06B 3/32; E06B 3/34; E06B 3/06; E05B 17/0012; E04F 21/0023; E04F 21/0053; B65D 81/05

USPC ..... 49/380; 206/325

See application file for complete search history.

(56) References Cited

U.S. PATENT DOCUMENTS

| | | | | |
|---|---|---|---|---|
| 2,700,441 | A * | 1/1955 | Cudini | E06B 1/52 52/214 |
| 2,917,790 | A | 12/1959 | Espenschied | |
| 3,992,833 | A | 11/1976 | Hulinsky | |
| 4,057,275 | A | 11/1977 | La Beaud | |
| 4,232,068 | A | 11/1980 | Hoh et al. | |
| 4,731,965 | A | 3/1988 | Jensen | |
| 4,739,561 | A | 4/1988 | Mills | |
| 4,858,384 | A | 8/1989 | Blankenship | |
| 4,858,386 | A | 8/1989 | Nail | |

(Continued)

*Primary Examiner* — Chi Q Nguyen

(74) *Attorney, Agent, or Firm* — Womble Bond Dickinson (US) LLP

(57) ABSTRACT

A shipping system for a pre-hung door having a door panel hinged to a frame. The shipping system includes a bracket configured to wrap at least partially around a portion of the frame, the bracket having a first leg for extending between the door panel and the frame. The first leg may include an opening passing therethrough. The opening is intended to align with an edge bore of the door panel and with a catch bore in the frame. The shipping system also includes a door plug for insertion into a face bore of the door panel to reside at least partially within the edge bore of the door panel. The door plug is designed to releasably engage the opening of the bracket by rotation of the door plug. The bracket is removable from the pre-hung door after the pre-hung door is installed in a rough opening.

18 Claims, 6 Drawing Sheets

(56) References Cited

U.S. PATENT DOCUMENTS

| | | | | |
|---|---|---|---|---|
| D319,007 | S | 8/1991 | Rogers et al. | |
| 5,054,250 | A | 10/1991 | Foss | |
| 5,159,782 | A | 11/1992 | Sales | |
| 5,209,017 | A | 5/1993 | Ridge | |
| 5,365,697 | A | 11/1994 | Vanderpan | |
| 5,474,347 | A | 12/1995 | Vigneault et al. | |
| 5,488,804 | A | 2/1996 | Datscher | |
| 5,562,315 | A | 10/1996 | Sales | |
| 5,566,509 | A | 10/1996 | Long | |
| 5,581,900 | A | 12/1996 | Payne | |
| 5,655,332 | A | 8/1997 | Papadopoulos | |
| 5,655,343 | A | 8/1997 | Seals | |
| D417,516 | S | 12/1999 | White | |
| 6,018,916 | A | 2/2000 | Henry | |
| 6,167,663 | B1 | 1/2001 | Nakamoto et al. | |
| 6,170,198 | B1 * | 1/2001 | Staples | E06B 7/00 49/380 |
| 6,216,402 | B1 | 4/2001 | Van de Laar | |
| 6,357,200 | B1 | 3/2002 | Vanderpan | |
| 6,725,604 | B1 | 4/2004 | Vanderpan | |
| 6,763,647 | B2 | 7/2004 | Yeany | |
| 6,966,119 | B1 | 11/2005 | Dlugoleski | |
| 7,118,143 | B2 | 10/2006 | L'Heureux et al. | |
| 7,121,045 | B2 | 10/2006 | Massey | |
| 7,165,793 | B2 | 1/2007 | Richmond et al. | |
| 7,213,371 | B1 | 5/2007 | Vanderpan | |
| 7,331,146 | B1 | 2/2008 | Beutler et al. | |
| 7,537,819 | B2 | 5/2009 | Hendricks | |
| 7,581,352 | B2 | 9/2009 | Klingbyle | |
| 7,591,073 | B1 | 9/2009 | Eckles et al. | |
| 7,856,760 | B2 | 12/2010 | Klingbyle | |
| 7,987,637 | B2 | 8/2011 | Smith | |
| 8,245,448 | B2 * | 8/2012 | Crane | E05B 17/0012 206/325 |
| 8,418,375 | B2 | 4/2013 | Zadnik | |
| 8,677,636 | B2 | 3/2014 | Kelley | |
| 8,732,972 | B2 | 5/2014 | Jordan | |
| 8,813,437 | B1 | 8/2014 | Spofford | |
| 9,010,704 | B2 | 4/2015 | Sirek et al. | |
| 9,194,170 | B2 | 11/2015 | Eis et al. | |
| 9,482,016 | B2 * | 11/2016 | Kelley | E04F 21/0007 |
| 2003/0005589 | A1 | 1/2003 | Hale et al. | |
| 2004/0060241 | A1 | 4/2004 | Staples et al. | |
| 2005/0086879 | A1 | 4/2005 | Sales | |
| 2005/0102906 | A1 * | 5/2005 | Massey | E05B 17/0012 49/380 |
| 2005/0284091 | A1 | 12/2005 | Sales | |
| 2006/0236611 | A1 | 10/2006 | Klingbyle | |
| 2008/0276421 | A1 | 11/2008 | Vanderpan | |
| 2012/0017452 | A1 * | 1/2012 | Lam | B23B 47/287 33/194 |
| 2012/0204434 | A1 | 8/2012 | Kelley | |
| 2013/0219732 | A1 | 8/2013 | Jordan | |
| 2017/0268240 | A1 | 9/2017 | Ege et al. | |

* cited by examiner

SHIPPING SYSTEM WITH PRE-HUNG DOOR

TECHNICAL FIELD

The present disclosure relates to building products and components for simplifying installation of building products. More particularly, the present disclosure relates to a shipping system for assisting with the shipping, handling and installation of pre-hung doors.

BACKGROUND

A common technique for the installation of an exterior door includes the use of a pre-hung door. A typical pre-hung door 10, as shown in FIG. 1, includes a frame 12 and a door panel 14. The frame 12 typically includes a threshold 16, a header 18, a latch-side jamb 20 and a hinge-side jamb 22. A plurality of hinges generally mount the door panel 14 to the hinge-side jamb 22. The pre-hung door 10 may then be installed within a rough opening 24 of a building defined by at least a pair of studs 26 and a cross beam 28.

Pre-hung doors 10 (also referred to as door units) are often preferred to separately hanging slab doors, especially for exterior entryways. This is because pre-hung doors 10 are pre-assembled to provide a tight fitting, substantially water-tight seal between the frame 12 and the door panel 14. Pre-hung doors 10, however, can lack rigidity prior to installation. Thus, portions of pre-hung doors 10 have been found to bend, bow, twist, expand, contract or otherwise shift during shipping, handling and installation. These changes can reduce the quality of the pre-assembled seal between the frame 12 and the door panel 14. Maintaining or returning to proper alignment and spacing between the door panel 14 and the surrounding frame 12 can be highly dependent upon installation practices and the skill of the installers.

The present disclosure seeks to provide an improved shipping system for holding the door panel 14 closed during shipping, handling, and installation of the pre-hung door 10, to simplify installation and enhance rigidity of the pre-hung door.

SUMMARY

The present disclosure describes a shipping system for a pre-hung door having a door panel hinged to a frame. The shipping system includes a bracket configured to wrap at least partially around a portion of the frame, the bracket having a first leg for extending between the door panel and the frame. The first leg may include an opening passing therethrough. The opening is intended to align with an edge bore of the door panel and with a catch bore in the frame. The shipping system also includes a door plug for insertion into a face bore of the door panel to reside at least partially within the edge bore of the door panel. The door plug is designed to releasably engage the opening of the bracket by rotation of the door plug. The bracket is removable from the pre-hung door after the pre-hung door is installed in a rough opening.

The present disclosure also describes a pre-hung door. The pre-hung door has a frame having a first vertical member and a second vertical member, the first vertical member comprising a catch bore extending into an inside face thereof. The pre-hung door also includes a door panel hingably attached to the second vertical member, the door panel comprising an edge bore extending into a free edge of the door panel, and a face bore extending through the door panel and communicating with the edge bore. The pre-hung door also includes a shipping system having a bracket wrapped at least partially around a portion of the first vertical member, the bracket having a first leg positioned between the door panel and the first vertical member, the first leg comprising an opening passing therethrough, wherein the opening is configured to align with the edge bore of the door panel and with the catch bore of the first vertical member. The shipping system also includes a door plug passing through the edge bore of the door panel, the door plug releasably engaged with the opening of the bracket by rotation of the door plug. Further, the door system may be designed so that the bracket is removable from the first vertical member after the pre-hung door is installed in a rough opening.

Other embodiments include a method of shipping and installing a door panel within a frame of a pre-hung door. The method comprises attaching a bracket on a vertical member of the frame of the pre-hung door. Then a door plug is inserted into a face bore of the door panel and then inserted along an edge bore of the door panel. Once inserted the door plug is twisted into engagement with the bracket.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 2:
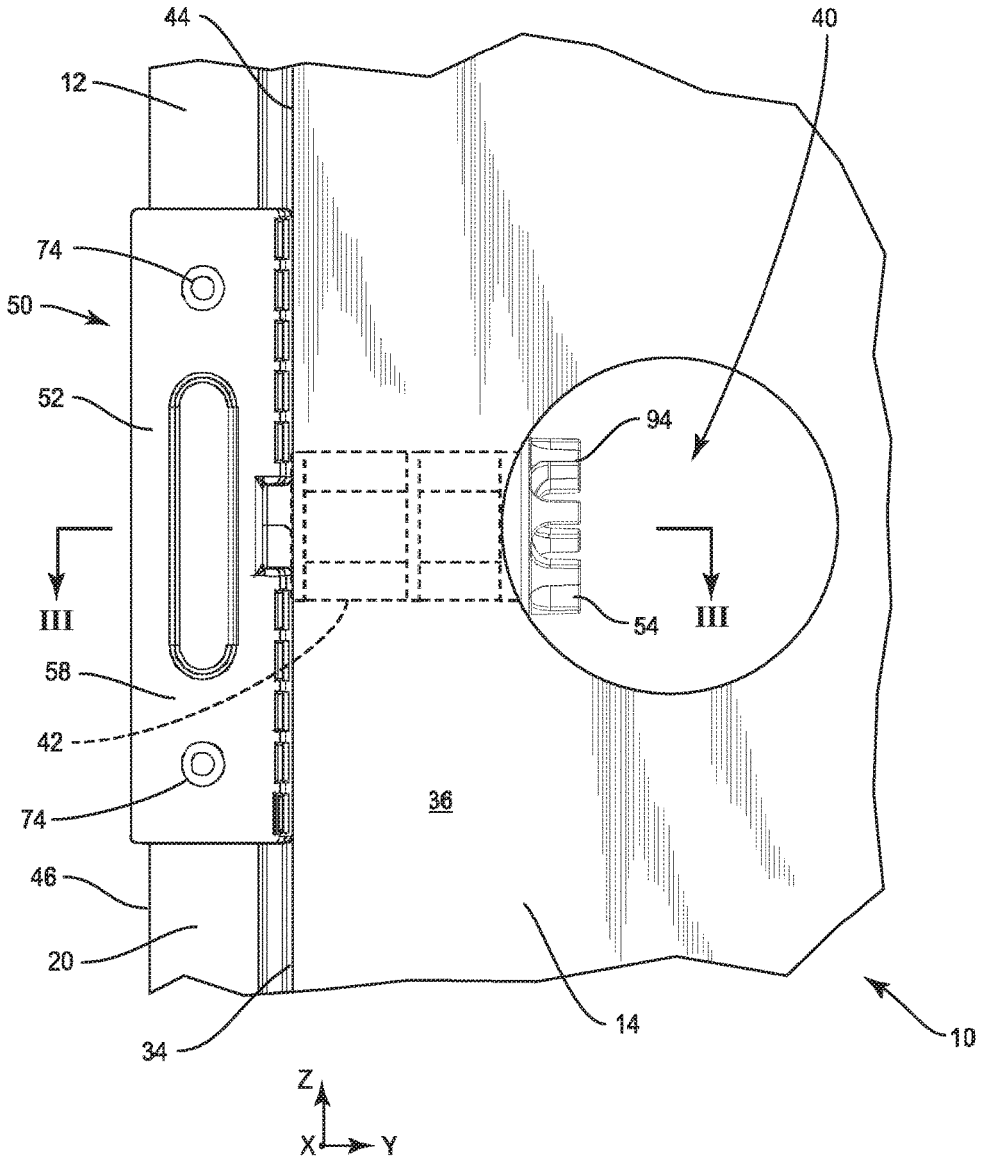
FIG. 2 is a detailed front view of a pre-hung door with a shipping system according to embodiments of the present disclosure.
Figure 3:
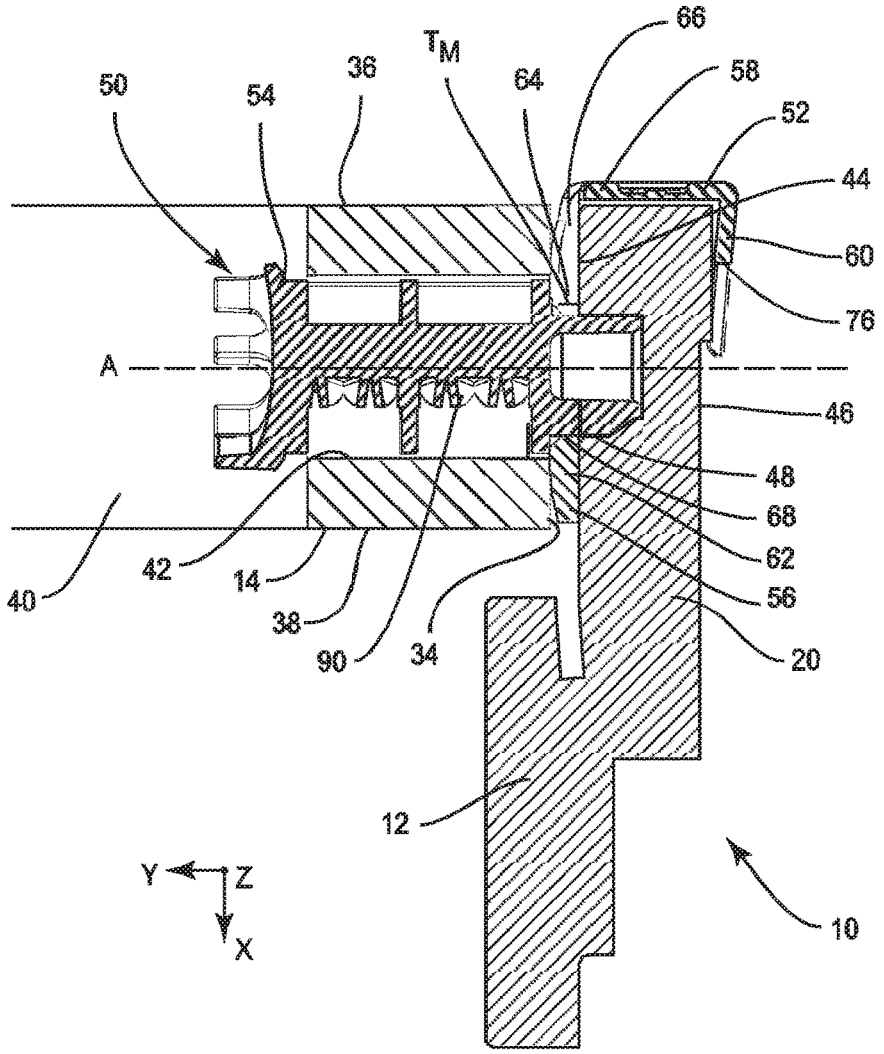
FIG. 3 is a detailed cross section taken at line III-III of FIG. 2.
Figure 4:
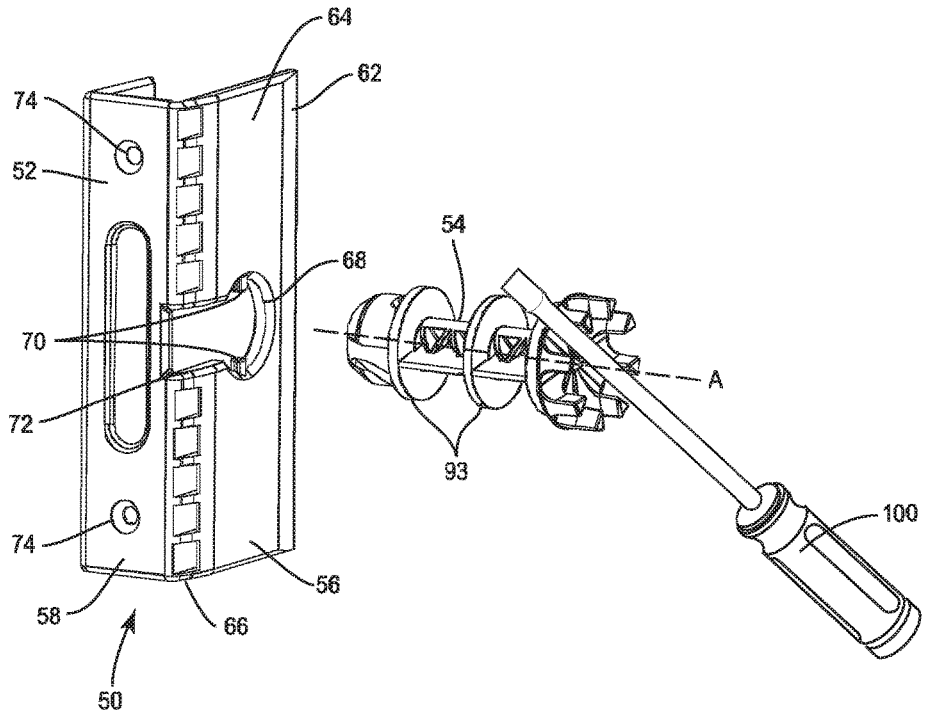
FIG. 4 is an exploded perspective view of the shipping system of FIG. 2.

With reference to FIGS. 2-4, the pre-hung door 10 includes a latch-side jamb 20 (hereinafter "jamb 20"). The jamb 20 may be referred to more generally by the term "vertical member" to include any generally vertical portion of a suitable frame 12, such as jambs, mullions, astragals, etc. The door panel 14 includes a free edge 34, an interior face 36 and an exterior face 38 (FIG. 3). As used herein, the terms "exterior" and "interior" are used relative to the building having the rough opening 24 along the X-axis. The door panel 14 includes at least one face bore 40 passing from the interior face 36 to the exterior face 38. The door panel 14 also includes an edge bore 42 extending from the free edge 34 into communication with the face bore 40. The jamb 20 may have an inside face 44 and an outside face 46. As used herein, the terms "inside" and "outside" are used relative to the Y-axis. A catch bore 48 may extend at least partially into the jamb 20 from the inside face 44 toward the outside face 46. In some embodiments, the catch bore may extend completely through the jamb 20 (see FIG. 6). The catch bore 48 is positioned to be generally coaxial with the edge bore 42 of the door panel 14 when the door panel is in the closed position. In a finished entryway, the catch bore 48 would receive a latch or a deadbolt extending from the free edge 34 of the door panel 14.

FIG. 2 shows a detailed front view of a pre-hung door 10 having a shipping system 50 according to embodiments of the present disclosure. The shipping system 50 may be used to retain the door panel 14 in a closed position relative to the frame 12 during shipping, handling and installation of the pre-hung door 10.

The shipping system 50 generally comprises a mounting bracket 52 (hereinafter "bracket 52") and a door plug 54. With reference to FIGS. 2-4, the bracket 52 wraps at least partially around a portion of the frame 12, such as a jamb 20. The bracket 52 may be formed from injection molded plastic or formed from other materials, such as metal. The bracket 52 includes a first leg 56 configured to extend between the door panel 14 and the frame 12. The bracket 52 includes a second leg 58 extending from the first leg 56 and configured to span the thickness of the jamb 20. The bracket 52 may also include a third leg 60 extending from the second leg 58 and configured to abut the outside face 46 of the jamb 20.

As seen in the cross section of FIG. 3, the first leg 56 may include a leading edge 62 having a tapered profile to facilitate insertion of the first leg between the free edge 34 of the door panel 14 and the inside face 44 of the jamb 20. The middle region 64 of the first leg 56 may have a thickness $T_M$ substantially equal to a predetermined margin between the free edge 34 and the inside face 44. By setting the thickness of at least a portion of the first leg 56 generally equal to the desired margin, the rigidity of the pre-hung door 10 may be improved and the possibility of misalignment during shipping, handling and installation may be reduced. The first leg 56 may also include a trailing edge 66 having a tapered profile. The taper of the trailing edge 66 may reduce interference as the door panel 14 is moved from an open position to a closed position.

As shown in FIG. 4, the first leg 56 of the bracket 52 includes an opening 68 passing therethrough. The bracket 52 is configured to be mounted to the jamb 20 such that the opening 68 is aligned with the edge bore 42 of the door panel 14 and with the catch bore 48 in the jamb 20. In other words, a central axis through the opening 68 may be substantially coaxial with the edge bore 42 and the catch bore 48 when the bracket 52 is properly positioned upon the jamb 20.

At least one projection 70 may extend substantially radially into the opening 68. The at least one projection 70 may function as a key as will be discussed further below.

Further, a slot 72 may be formed in the first leg 56 traversing from the trailing edge 66 into communication with the opening 68. The slot 72 may provide a line of sight to assist with the alignment of the bracket 52 with the catch bore 48 and the edge bore 42.

As seen in FIG. 4, the second leg 58 of the bracket 52 may be provided with holes 74 for receiving optional fasteners. The fasteners (not shown) could be used to screw the bracket 52 into attachment with the jamb 20. The use of fasteners is expected to be optional. For example, as seen in FIG. 3, the third leg 60 may be formed to converge toward the first leg 56. By having the third leg 60 converge with the first leg 56, the third leg may be able to function as a resilient clamping leg. Thus, the bracket 52 may be mounted to the jamb 20 by a friction fit or compression fit as the jamb is squeezed between the first leg 56 and the third leg 60.

Figure 1:
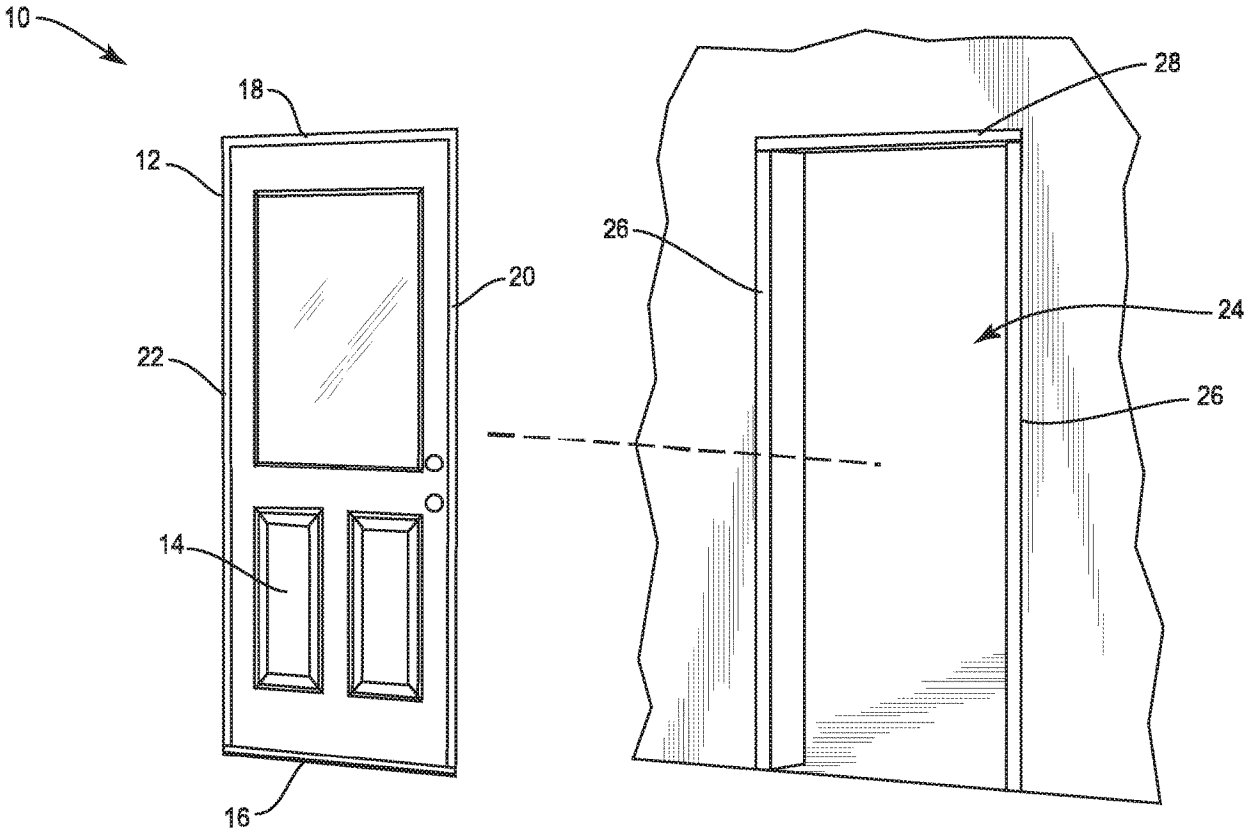
FIG. 1 PRIOR ART
FIG. 1 is an exploded perspective view of a typical pre-hung door being installed into an exterior rough opening of a building.

The third leg 60 of the bracket 52 may be designed to be sufficiently thin to fit between the outside face 46 of the jamb 20 and the stud 26 (FIG. 1) of the rough opening 24. A terminal edge 76 of the third leg 60 may be configured to end prior to the catch bore 48. This configuration may assist with the removal of the bracket 52 as will be discussed further below.

As referenced above, the shipping system 50 also includes a door plug 54. Generally, the door plug 54 has a size and shape such that the door plug may be inserted into the edge bore 42 via the face bore 40 of the door panel 14. The door plug 54 engages the bracket 52, and the door panel 14 is held in a closed position relative to the frame 12.

Figure 5A:
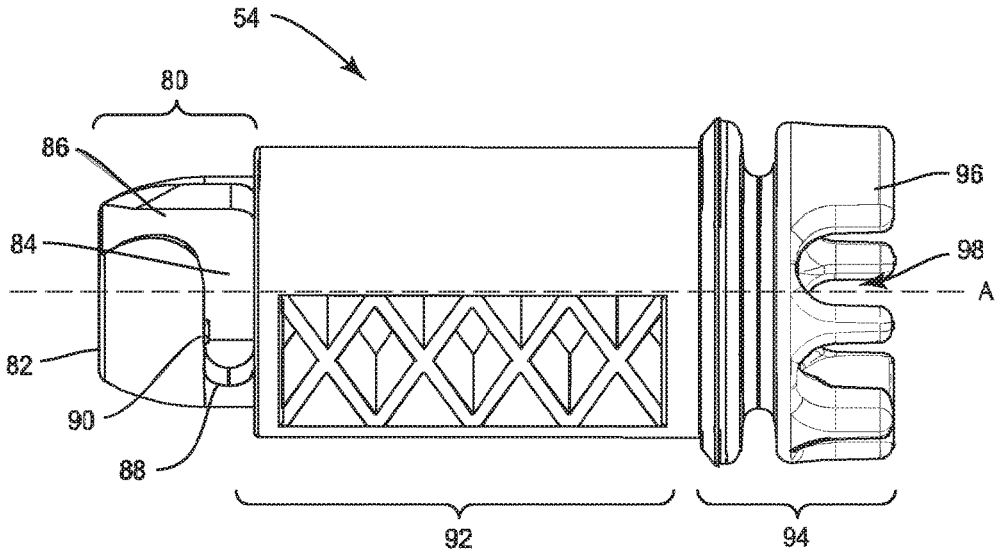
FIG. 5A is a side view of a door plug according to another embodiment.
Figure 5B:
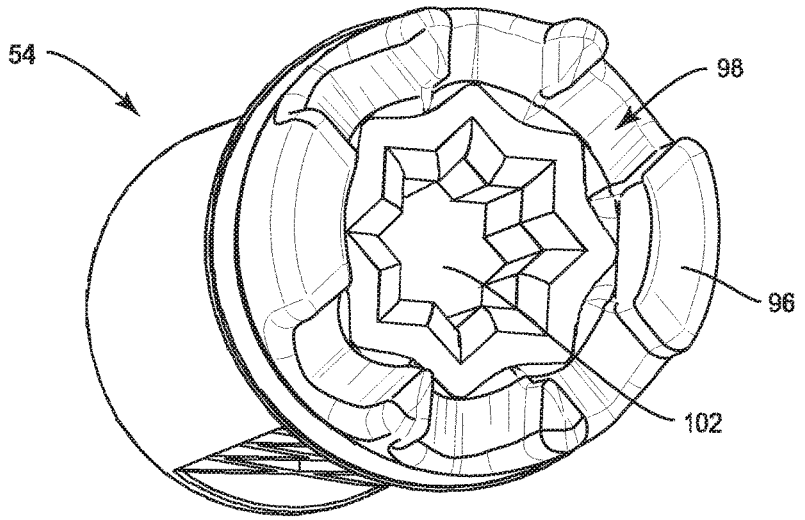
FIG. 5B is an end perspective view of the door plug of FIG. 5A.

The door plug 54 according to alternative embodiments may be best seen in FIGS. 4, 5A and 5B. The door plug 54 may include an attachment portion 80 (e.g. a tip) configured to engage the opening 68 of the bracket 52. The attachment portion 80 may have a tapered distal end 82 and a diameter configured to produce a close fit within the opening 68. The close fit minimizes movement of the door panel 14 when the shipping system 50 is in use. The attachment portion 80 may have one or more grooves 84 for alignment and interaction with respective one of the projections 70 of the opening 68. The grooves 84 may be generally L-shaped, with a substantially longitudinal insertion segment 86 and a substantially circumferential locking segment 88. The insertion segment 86 may open to the distal end 82 of the door plug 54 for accepting a corresponding projection 70. As the attachment portion 80 of the door plug 54 at least partially passes through the opening 68 and at least partially enters the catch bore 48, the projection 70 travels along the insertion segment 86. In one embodiment, the insertion segment 86 has a length that prevents the door plug 54 from passing completely though the jamb 20. When the door plug 54 is substantially fully inserted into the opening 68, the door plug may be rotated about a longitudinal axis A such that the projection 70 follows the locking segment 88 of the groove 84. The magnitude and direction of rotation of the door plug 54 may be guided or controlled by the interaction between the projection 70 and the locking segment 88. In one embodiment, the door plug 54 may be fully engaged with the bracket 52 by a quarter-turn. In other embodiments, a half-turn may be used. The locking segment 88 may include a protrusion 90 (FIG. 5A). The protrusion 90 may assist with holding the projection 70 in the locked position. The protrusion 90 may provide the installer with additional tactile feedback that the door plug 54 is fully engaged.

The door plug 54 may also include a body portion 92 (e.g. a shaft) adjacent to the attachment portion 80. The body portion 92 of the door plug 54 is the region of the door plug generally configured to reside within the edge bore 42 of the door panel 14 when the shipping system 50 is in use. The body portion 92 may be configured to minimize radial movement of the door plug 54 when positioned within the edge bore 42. Therefore, the diameter of the edge bore 42 and the diameter of at least a portion of the body portion 92 should be substantially similar. In the illustrated embodiment of FIG. 4, the body portion 92 is designed with a series of radial flanges 93 for close fitting with the inner diameter of the edge bore 42. Use of radial flanges 93, as compared to a continuous outer diameter, may reduce material requirements and may also reduce friction between the body portion 92 and the edge bore 42, to facilitate the desired rotation of the door plug 54. In the embodiment of FIGS. 5A and 5B, the body portion 92 has more of the outer surface corresponding with the diameter of the edge bore 42. This may provide a closer fit with the edge bore 42. In either embodiment, the body portion 92 may be provided with cavities or recesses to improve manufacturability of the door plug 54. For example, the cavities seek to make the thickness of each portion of the body 92 generally similar to avoid undesired deformation during cooling of an injection molded part.

The door plug 54 may also include a handle portion 94 (e.g. a head). The handle portion 94 may reside within the face bore 40 of the door panel 14 when the shipping system 50 is in use. The handle portion 94 should be accessible to the user so that the handle portion may be used to facilitate rotation of the door plug 54 into and out of releasable engagement with the bracket 52. The handle portion 94 may comprise at least one receiver for insertion of a tool to assist with rotation of the door plug 54. In one embodiment, the handle portion 94 comprises a circumferential ring 96 coaxial with the door plug 54. The ring 96 includes plurality of axially opposed recesses 98 spaced axially around the ring 96. The recesses 98 may act as a receiver for a tool, such as a screwdriver 100. The screwdriver 100 may engage a pair of the recesses 98 to provide a mechanical advantage as the door plug 54 is rotated into engagement with the bracket 52.

Additionally or alternatively, the handle portion 94 may include a pocket 102 (FIG. 5B) to act as a receiver. In the illustrated embodiment, the pocket 102 is formed centrally and axially into the handle portion 94. The pocket 102 may be provided in a variety of shapes. The illustrated pocket 102 is configured as a double square drive, two squares rotationally offset by forty-five degrees, such that the pocket 102 is configured to accept a square head wrench into one of eight positions. The pocket 102 could alternatively be configured for an Allen wrench.

Having described the structure of the shipping system 50 according to one embodiment, possible advantages of the disclosed shipping system will now be described. For example, the shipping system 50 is configured to be removable from the pre-hung door 10 after the pre-hung door is installed in the rough opening 24. In other words, the shipping system 50 may be removed from the jamb 20 without substantial access to the outside face 46 of the jamb. After installation of the pre-hung door 10 into the rough opening 24, the door plug 54 may be rotated by access through the face bore 40, to disengage the door plug from the bracket 52. The door plug 54 may then be removed via the face bore 40 of the door panel 14. The bracket 52 may then be removed from the jamb 20 by removing any fasteners provided in the holes 74 and then pulling the bracket 52 away from the frame 12. Conventional shipping systems often do not allow for post-installation removal. Particularly, conventional shipping systems secure a door plug with a fastener that extends through the catch bore from the outside face of the jamb. Thus the fastener must be removed prior to installing the pre-hung door into the rough opening, since after installation, the outside face of the jamb is not usually sufficiently accessible to remove the fastener. While an exemplary embodiment has been described in detail above, other structures and configurations that allow the shipping system 50 to be removable from the pre-hung door 10 after the pre-hung door is installed in a rough opening 24 will be apparent to those of ordinary skill in the art.

The shipping system 50 described herein also facilitates a new method of shipping and installing a door panel 14 within a frame 12 of a pre-hung door 10. The method may include, first, attaching the bracket 52 on a jamb 20 of the frame 12. Then, the door plug 54 is inserted into the face bore 40 of the door panel 14 and then through the edge bore 42. The door plug 54 is then engaged with the bracket 52 to hold the door panel 14 in a closed position relative to the frame 12 by twisting the door plug into engagement with the bracket.

Figure 6:
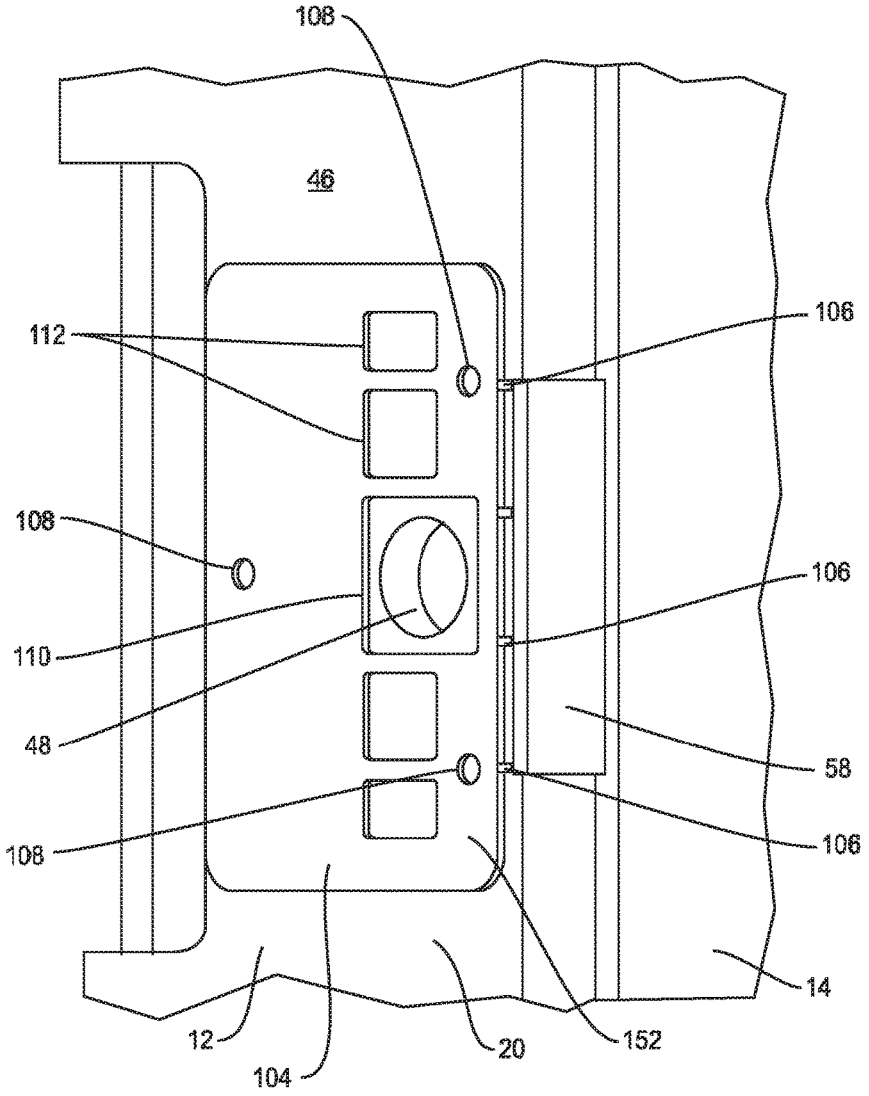
FIG. 6 is a detailed outside perspective view of a pre-hung door with a bracket according to another embodiment.

Turning to FIG. 6, a bracket 152 according to a second embodiment is shown. The bracket 152 replaces the third leg 60 (FIG. 3) with a security plate 104. Otherwise, features of the second bracket 152 are substantially similar to the features of the first bracket 52 discussed above. The security plate 104 extends substantially parallel with the first leg (not shown in FIG. 6), and is integrated with the bracket 152 with webbing in the form of a plurality of attachment tabs 106. The bracket 152 may be a unitary one-piece initial construction. To provide the security plate 104 with sufficient strength, the bracket 152 may be formed from a metal material. The security plate 104 may be fixedly mounted to the jamb 20 by fasteners (e.g. screws, not shown) passing through mounting holes 108. The attachment tabs 106 may be designed to allow the security plate 104 to be separated from the remainder of the bracket 152 after the pre-hung door has been installed. For example, repeated bending of the second leg 58 relative to the security plate 104 is expected to weaken and eventually allow for the attachment tabs 106 to be broken. After the pre-hung door is installed, the door panel 14 may be opened, allowing clearance such that the second leg 58 and the remainder of the bracket 152 may pivot about an axis corresponding with the attachment tabs 106.

After separation from the bracket 152, the security plate 104 is designed and configured to function similarly to conventional security plates known in the art. For example, the security plate 104 is configured to reinforce the jamb 20 to help prevent break-in. Particularly, the security plate 104 includes a deadbolt aperture 110 that may correspond with the catch bore 48. A deadbolt from the door panel 14 may pass completely through the catch bore 48. If the deadbolt were to damage the catch bore 48, interaction between the deadbolt aperture 110 and the deadbolt is configured to increase the strength and security of the jamb 20. Additional apertures 112 may also be strategically located in the security plate 104 to allow for clearance of other fasteners, such as screws used to attach a strike plate to the jamb 20.

When a bracket 152 having a security plate 104 is used, the method of shipping and installing the pre-hung door may further include screwing the security plate 104 onto the jamb 20. The steps to remove the bracket 152 after the pre-hung door 10 has been installed in the rough opening 24 may further include separating the bracket from the security plate 104.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A shipping system, for a pre-hung door with a door panel hinged to a frame, the shipping system comprising:

a bracket configured to wrap at least partially around a portion of the frame, the bracket having a leg configured to extend between the door panel and the frame, the leg comprising an opening passing therethrough, wherein the opening is configured to align with an edge bore of the door panel and with a catch bore in the frame; and a door plug configured for insertion into a face bore of the door panel and configured to reside at least partially within the edge bore of the door panel, the door plug configured to releasably engage the opening of the bracket by rotation of the door plug, wherein the bracket is removable from the pre-hung door after the pre-hung door is installed in a rough opening, wherein the bracket comprises at least one projection extending radially into the opening, and wherein the door plug comprises a groove for accepting the at least one projection, the groove comprising a first segment open to a distal axial end of the door plug for insertion of the at least one projection.

2. The shipping system of claim 1, wherein the groove comprises at least a second segment extending circumferentially from the first segment to guide rotation of the door plug.

3. The shipping system of claim 1, further comprising a security plate extending substantially parallel with the leg and integrated with the bracket with a plurality of attachment tabs, wherein the security plate is configured to fixedly mount to the frame and be separable from the bracket by breaking the plurality of attachment tabs.

4. The shipping system of claim 1, wherein the leg has a thickness corresponding with a desired margin between the frame and the door panel.

5. The shipping system of claim 1, wherein the door plug includes:

an attachment portion configured to engage the opening of the bracket, a body portion configured to fit within the edge bore of the door panel, and a handle portion configured to reside within the face bore of the door panel and be accessible for rotating the door plug.

6. The shipping system of claim 5, wherein at least a portion of the body portion has a diameter configured to fit closely within the edge bore of the door panel.

7. The shipping system of claim 5, wherein the handle portion comprises at least one receiver for insertion of a tool to assist with rotation of the door plug.

8. A pre-hung door, comprising:

a frame having a first vertical member and a second vertical member, the first vertical member comprising a catch bore extending into an inside face thereof;

a door panel hingably attached to the second vertical member, the door panel comprising:

an edge bore extending into a free edge of the door panel, and a face bore extending through the door panel and communicating with the edge bore; and a shipping system, the shipping system comprising:

a bracket wrapped at least partially around a portion of the first vertical member, the bracket having a leg positioned between the door panel and the first vertical member, the leg comprising an opening passing therethrough, wherein the opening is configured to align with the edge bore of the door panel and with the catch bore of the first vertical member; and a door plug passing through the edge bore of the door panel, the door plug releasably engaged with the opening of the bracket by rotation of the door plug, wherein the bracket is removable from the first vertical member after the pre-hung door is installed in a rough opening, wherein the bracket comprises at least one projection extending radially into the opening, and wherein the door plug comprises a groove for accepting the at least one projection, the groove comprising a first segment open to a distal axial end of the door plug for insertion of the at least one projection.

9. The pre-hung door of claim 8, wherein the groove comprises at least a second segment extending circumferentially from the first segment to guide rotation of the door plug.

10. The pre-hung door of claim 8, further comprising a security plate extending substantially parallel with the leg and integrated with the bracket with a plurality of attachment tabs, wherein the security plate is fixedly mounted to the first vertical member and is configured to be separable from the bracket by breaking the plurality of attachment tabs.

11. The pre-hung door of claim 8, wherein the leg has a thickness corresponding with a desired margin between the first vertical member and the door panel.

12. The pre-hung door of claim 8, wherein the door plug includes:

an attachment portion configured to engage the opening of the bracket, a body portion configured to fit within the edge bore of the door panel, and a handle portion configured to reside within the edge bore of the door panel and be accessible for rotating the door plug.

13. The pre-hung door of claim 12, wherein at least a portion of the body portion has a diameter configured to fit closely within the edge bore of the door panel.

14. The pre-hung door of claim 12, wherein the handle portion comprises at least one receiver for insertion of a tool to assist with rotation of the door plug.

15. A method of shipping and installing a door panel within a frame of a pre-hung door, the method comprising:

attaching a bracket on a vertical member of the frame of the pre-hung door, the bracket having a leg configured to extend between the door panel and the frame, the leg comprising an opening passing therethrough, the bracket also comprising at least one projection extending radially into the opening, wherein the opening is arranged to align with an edge bore of the door panel and with a catch bore in the frame;

then inserting a door plug into a face bore of the door panel and then along an edge bore of the door panel, the door plug comprising a groove for accepting the at least one projection, the groove comprising a first segment open to a distal axial end of the door plug;

inserting the at least one projection into the first segment; and then twisting the door plug into engagement with the bracket.

16. The method of claim 15, wherein a security plate is integrated with the bracket, and attaching the bracket comprises screwing the security plate onto the vertical member.

17. The method of claim 16, further comprising:

installing the pre-hung door within a rough opening;

then disengaging the door plug from the bracket; and then removing the bracket from the vertical member, wherein removing the bracket from the vertical member comprises separating the bracket from the security plate.

18. The method of claim 15, wherein the groove comprises at least a second segment extending circumferentially from the first segment, and twisting the door plug into engagement with the bracket comprises sliding the projection along the second segment.

* * * * *